United States Patent [19]

Finkelstein

[11] 4,430,764

[45] Feb. 14, 1984

[54] WAVELESS WATERBED WITH BUOYANT HONEYCOMB CORE

[76] Inventor: Alberto L. Finkelstein, 147 S. Thistle St., Brea, Calif. 92621

[21] Appl. No.: 312,626

[22] Filed: Oct. 19, 1981

[51] Int. Cl.[3] ..... A47C 27/08

[52] U.S. Cl. ..... 5/450; 5/451

[58] Field of Search ..... 5/451, 452, 422, 450, 5/449, 455

[56] References Cited

U.S. PATENT DOCUMENTS 4,145,780 3/1979 Fogel ..... 5/451

4,241,465 12/1980 Yarimie et al. ..... 5/452

4,296,510 10/1981 Phillips ..... 5/451

4,345,348 8/1982 Hall ..... 5/451

*Primary Examiner*—Alexander Grosz

*Attorney, Agent, or Firm*—Kendrick, Netter & Bennett

[57] ABSTRACT

A waterbed mattress includes a buoyant honeycomb core structure attached only to the bottom wall of the mattress. The core structure includes a plurality of openings and a plurality of buoyant members integrally formed with the core and containing buoyant, flotation-promoting means sealed inside them.

2 Claims, 5 Drawing Figures

WAVELESS WATERBED WITH BUOYANT HONEYCOMB CORE

This invention relates to waterbeds and more particularly to waterbeds comprising honeycomb means for suppressing wave-like motion of water within the mattress.

Waterbeds have become very popular in recent years. Even so, many persons are annoyed by the wave-like motion of water in such beds. Attempts to eliminate the wave-like motion, such as by the use of longitudinally-extending baffles connected to the top and bottom walls of the mattress, reduce the wave-like motion, but create another problem. Specifically, they restrict the movement of the top wall, and can lead to over-inflation in localized regions of the mattress. Over-inflation makes the mattress excessively firm and prevents the desired flotation support in regions where it occurs. Further, waveless mattresses heretofore known can trap water in regions of the mattress, resulting in overheating in such regions.

U.S. Pat. No. 4,241,465, issued Dec. 30, 1980, and entitled, "Waveless Waterbed Mattress," discloses a waterbed mattress having a honeycomb core means for damping the wave-like water movement inside a waterbed mattress. This honeycomb core is not attached to the top or bottom wall of the mattress. Openings in the honeycomb core of this mattress permit water to circulate inside the mattress, preventing formation of localized regions of excessive heating.

My invention relates to a waterbed mattress comprising a buoyant honeycomb core means attached only to the bottom wall of the mattress, but not to the side walls or top wall of the waterbed mattress. My buoyant honeycomb mattress includes a plurality of buoyant means between the openings in the honeycomb core structure. Preferably, the buoyant means are tubes integrally formed with the honeycomb core that have flotation-promoting means sealed inside them.

The honeycomb core means includes, in a preferred embodiment, a plurality of sheets joined to one another at spaced, preferably regularly spaced, intervals along lines extending laterally across the sheets. The honeycomb core must include at least two such sheets, but preferably includes at least four or more such sheets, each joined to a contiguous sheet along such lines. The buoyant means are formed integrally with the core by joining contiguous sheets along parallel lines to form tubular openings between the open spaces in the honeycomb, and by inserting and sealing within these tubular openings flotation-promoting means such as foamed plastic, fabric material, or other buoyant substance.

In this preferred embodiment, the sheets forming the honeycomb core have integral tabs formed at the top and bottom of each sheet. The tabs facing one another on contiguous sheets form the ends of the tubes for the flotation-promoting means. The tabs formed at the bottom of the honeycomb core can also constitute means for attaching the honeycomb core means to the bottom wall of the waterbed mattress, leaving the side walls and the top wall of the mattress unattached to the honeycomb core.

My invention can better be understood by reference to the appended drawings, in which.

Figure 3:
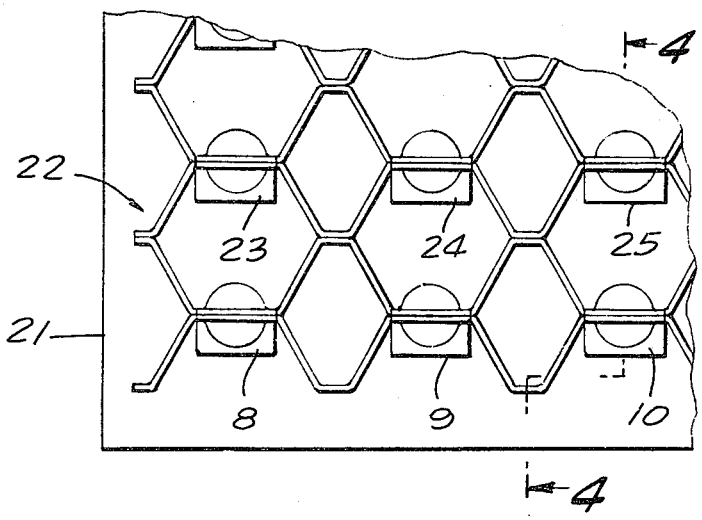
FIG. 3 is a fragmentary, exploded plan view of the honeycomb core of my new waterbed mattress attached to the bottom wall of a waterbed mattress.
Figure 4:
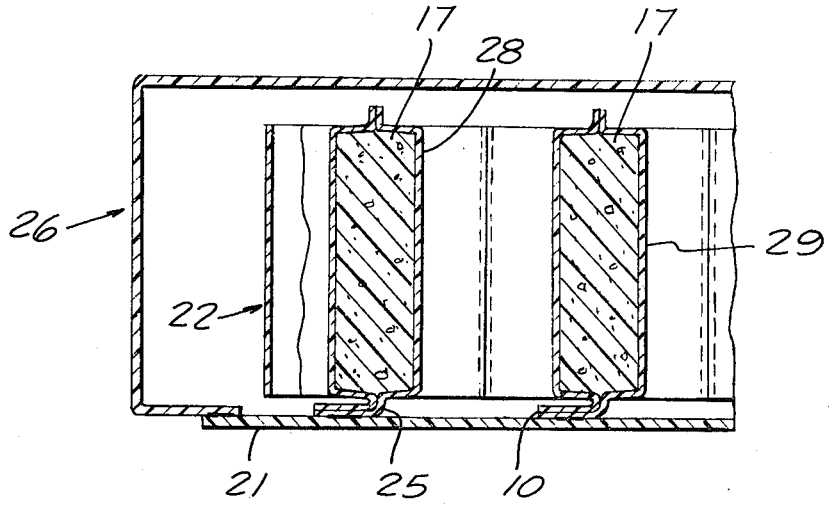
Figure 5:
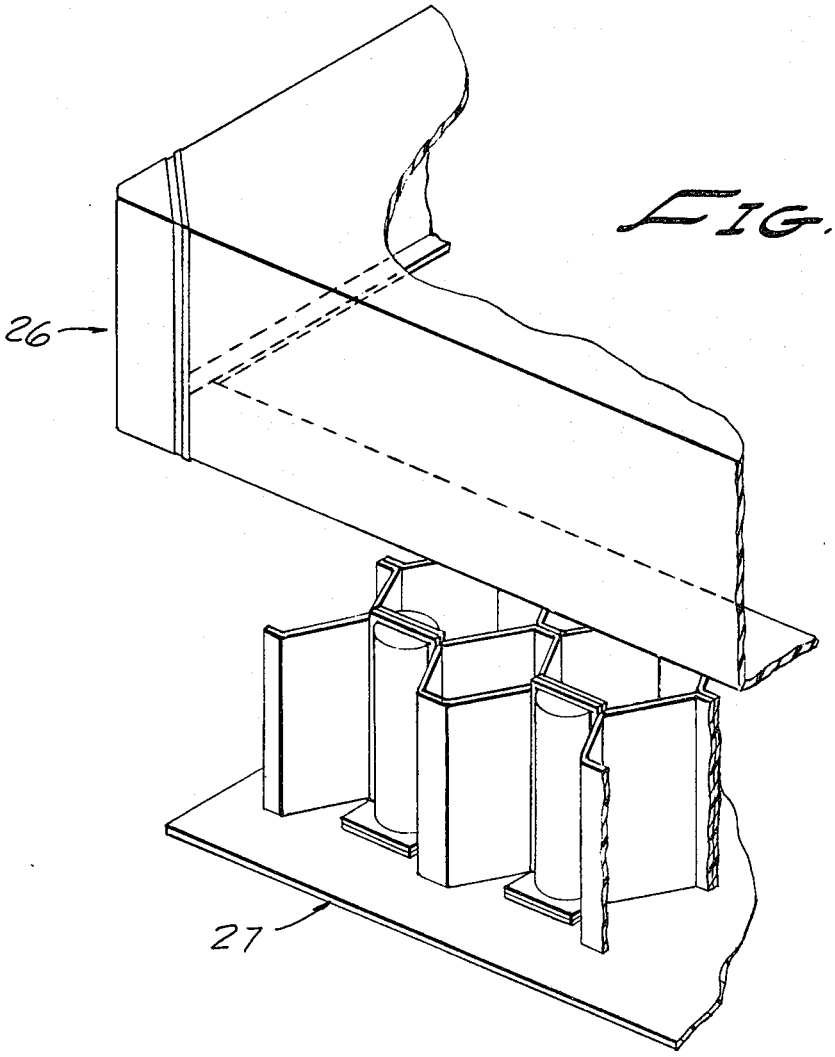

FIG. 4 is a fragmentary, sectional elevation view, taken on line 4—4 in FIG. 3, showing my new waterbed mattress and a portion of its honeycomb core with its integrally-formed buoyant means shown in cross-section between the open areas in the honeycomb and with the honeycomb core attached to the bottom of the waterbed mattress by tabs integrally formed at the base of the buoyant means in the honeycomb core; and FIG. 5 shows a fragmentary perspective view of the bottom wall of my waterbed mattress with a honeycomb core attached thereto, and with the top and side wall structure of the waterbed mattress in position for attachment to the bottom wall/honeycomb core assembly.

Figure 1:
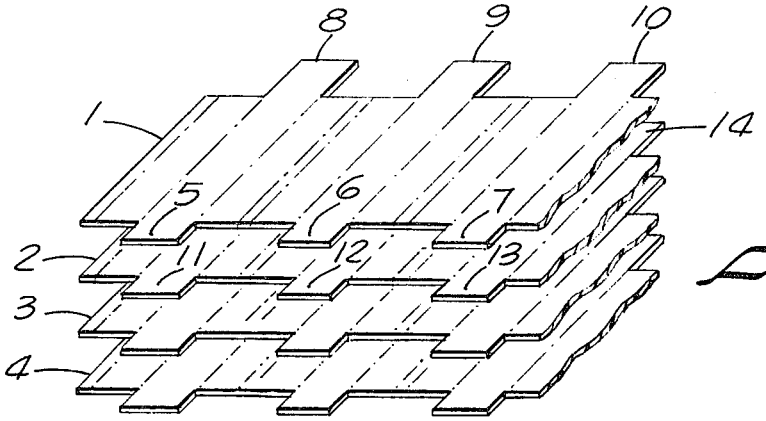
FIG. 1 shows a fragmentary perspective view of an array of four sheets for forming a honeycomb core for my new waterbed mattress.

FIG. 1 shows a perspective view of a plurality of thermoplastic sheets 1, 2, 3 and 4 for forming the honeycomb core structure of my new mattress. Preferably, these sheets are made of polyvinylchloride, and are identical in size and shape. Protruding from the top of sheet 1 are tabs 5, 6 and 7, which form the top of the tubular openings for the buoyancy-promoting means in the honeycomb structure. Sheet 1 (and each of the other sheets) also includes tabs 8, 9 and 10 protruding from the bottom of sheet 1, which form the bottom of the tubular openings for the buoyancy-promoting means. These tabs 8, 9 and 10 also provide means for attaching the honeycomb core to the bottom wall of the waterbed mattress. Sheets 2, 3 and 4 contain top and bottom tabs of identical size and shape in the same locations as the tabs on sheet 1. For example, sheet 2 includes tabs 11, 12 and 13 at the top and tab 14 at the bottom, opposite tab 13. Tabs of the same size and shape as tabs 8 and 9 on sheet 1 are at the bottom of sheet 2 opposite tabs 8 and 9 on sheet 1.

Figure 2:
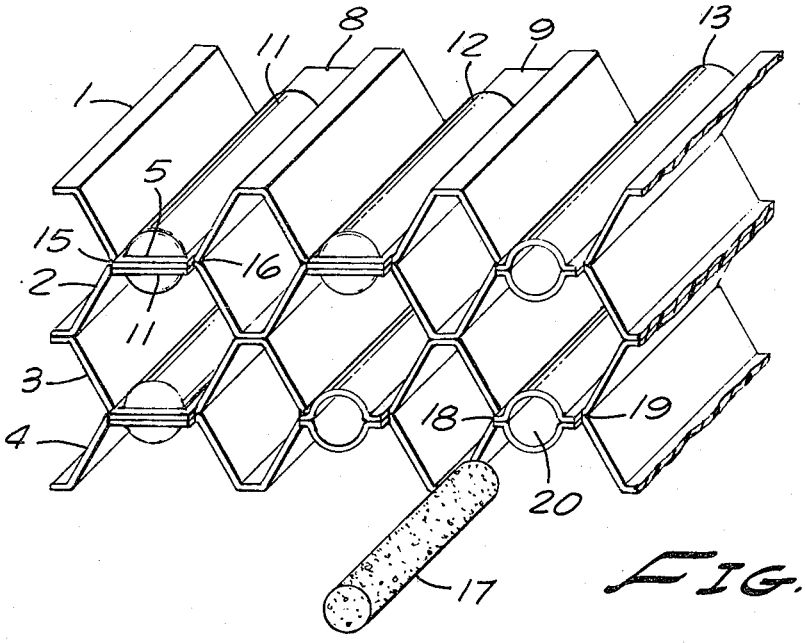
FIG. 2 shows a perspective view, shown in partial assembly, of the four sheets shown in FIG. 1 joined to one another along spaced, parallel lines to form the honeycomb core with integrally-formed tubes for the flotation-promoting means.

FIG. 2 shows the four sheets 1, 2, 3 and 4 from FIG. 1 joined to one another along regularly spaced, parallel lines which extend laterally across the sheets. For example, sheet 1 is joined to sheet 2 along parallel lines 15 and 16 which extend laterally across sheets 1 and 2. Between lines 15 and 16 is an integrally-formed, sealed tubular opening containing a buoyancy-promoting means such as a tubular-shaped fibrous core 17.

In the manufacture of my honeycomb core, I first form the joints between the sheets along lines such as 18 and 19 between sheets 3 and 4. By so doing, I form the tubular openings to receive the buoyancy-supporting means. Then, I insert buoyancy-supporting means such as tubular-shaped fibrous material 17 in the tubular opening and seal the tubular openings such as 20 at the top and at the bottom to prevent water from entering these openings. Thus, for example, at the top of each tubular opening, I seal tabs such as 5 and 11 to close the top of the tubular opening. I also seal tabs such as tab 8 and the corresponding tab on sheet 2 to one another to close the bottom of the tubular opening. Tab 8 at the bottom of the tubular opening is sufficiently long to facilitate attachment to the bottom wall of the mattress, as FIG. 3 shows.

FIG. 3 shows a waterbed mattress bottom wall 21 with the honeycomb core means of my invention, generally designated 22, attached thereto by means such as tabs 8, 9, 10, 23, 24 and 25. Indeed, the tab at the bottom of each buoyant means is also attached to the bottom wall.

FIG. 4 shows a cross-sectional view of a portion of my honeycomb structure 22 attached to mattress bottom wall 21 by means of tabs such as 10 and 25. Inside buoyant means 28 and 29 are sealed tubular shaped, fibrous buoyancy-supporting means 17. Because buoyancy means 28 and 29 are sealed top and bottom, no water enters them.

FIGS. 4 and 5 show that, in our preferred embodiment, the top wall and four side walls of our waterbed mattress are formed as a unit, and then attached to the honeycomb bottom wall structure 27. A complete disclosure of the top and side wall structure 26, and of the method of making this structure appears in copending U.S. patent application Ser. No. 249,888, filed Apr. 1, 1981, in the names of Alberto L. Finkelstein and Carlos A. Mollura, and entitled, "Baffled Waterbed Mattresses and Methods of Making Such Mattresses."

In general, structure 27 is made from a single sheet of thermoplastic material by cutting a rectangular piece from each corner of the sheet, folding the sheet into a five-sided structure including a top wall and four side walls, and then attaching corner-reinforcement means to each corner of the top wall/side wall structure. The five-sided structure is then heat-sealed to the bottom wall of the mattress to form the finished mattress.

What is claimed is:

1. A waterbed mattress comprising a top wall, a bottom wall, and four side walls, and including a buoyant honeycomb core means attached only to the bottom wall of the mattress and including a plurality of buoyant means between the openings in, and integrally formed with, said honeycomb core means, said honeycomb core comprising a plurality of sheets joined to one another at spaced intervals along lines extending laterally across said sheets and comprising a plurality of open areas between said lines and a plurality of sealed tubular areas between said open areas, said buoyant means comprising flotation-promoting means sealed inside said tubular areas.

2. A honeycomb core means for waterbed mattresses comprising a plurality of buoyant means between the openings in the honeycomb core structure, said buoyant means being integrally formed with the honeycomb core and having flotation-promoting means sealed inside tubular portions of the core, said core comprising a plurality of sheets joined to one another at spaced intervals along lines extending laterally across said sheets, and comprising a plurality of open areas between said lines and a plurality of said tubular portions between said open areas.

* * * * *